US007100308B2

(12) United States Patent
Aveni

(10) Patent No.: US 7,100,308 B2
(45) Date of Patent: Sep. 5, 2006

(54) FOOTWEAR WITH A HEEL PLATE ASSEMBLY

(75) Inventor: Michael A. Aveni, Lake Oswego, OR (US)

(73) Assignee: Nike, Inc., Beaverton, OR (US)

( * ) Notice: Subject to any disclaimer, the term of this patent is extended or adjusted under 35 U.S.C. 154(b) by 61 days.

(21) Appl. No.: 10/719,668

(22) Filed: Nov. 21, 2003

(65) Prior Publication Data

US 2005/0108897 A1 May 26, 2005

(51) Int. Cl.
*A43B 13/28* (2006.01)

(52) U.S. Cl. ..... 36/27; 36/25 R; 36/30 R; 36/144

(58) Field of Classification Search ..... 36/25 R, 36/30 R, 27, 35 R, 142, 143, 144
See application file for complete search history.

(56) References Cited

U.S. PATENT DOCUMENTS

| | | | | | |
|---|---|---|---|---|---|
| 2,616,190 | A | * | 11/1952 | Darby | 36/144 |
| 3,738,373 | A | * | 6/1973 | Glancy | 36/144 |
| 4,183,156 | A | | 1/1980 | Rudy | 36/44 |
| 4,219,945 | A | | 9/1980 | Rudy | 36/29 |
| 4,255,877 | A | | 3/1981 | Bowerman | 36/129 |
| 4,287,675 | A | | 9/1981 | Norton et al. | 36/129 |
| 4,288,929 | A | | 9/1981 | Norton et al. | 36/69 |
| 4,354,318 | A | | 10/1982 | Frederick et al. | 36/30 |
| 4,364,188 | A | | 12/1982 | Turner et al. | 36/31 |
| 4,364,189 | A | | 12/1982 | Bates | 36/31 |
| 4,492,046 | A | | 1/1985 | Kosova | 36/27 |
| 4,566,206 | A | | 1/1986 | Weber | 36/78 |
| 4,620,376 | A | * | 11/1986 | Talarico, II | 36/103 |
| 4,685,227 | A | * | 8/1987 | Simmons | 36/127 |
| 5,159,767 | A | * | 11/1992 | Allen | 36/27 |
| 5,203,095 | A | | 4/1993 | Allen | 36/27 |
| 5,247,742 | A | | 9/1993 | Kilgore et al. | 36/114 |
| 5,367,790 | A | | 11/1994 | Gamow et al. | 36/27 |
| 5,435,079 | A | * | 7/1995 | Gallegos | 36/38 |
| 5,701,686 | A | | 12/1997 | Herr et al. | 36/27 |
| 6,029,374 | A | | 2/2000 | Herr et al. | 36/27 |
| 6,092,314 | A | * | 7/2000 | Rothbart | 36/144 |
| 6,247,249 | B1 | * | 6/2001 | Lindqvist | 36/28 |
| 6,449,878 | B1 | | 9/2002 | Lyden | 36/27 |
| 6,601,042 | B1 | | 7/2003 | Lyden | 705/26 |
| D507,094 | S | | 7/2005 | Lyden | |
| 6,939,502 | B1 | | 9/2005 | Lyden | |
| 2002/0129516 | A1 | * | 9/2002 | Lucas et al. | 36/35 R |
| 2003/0051372 | A1 | | 3/2003 | Lyden | |
| 2003/0069807 | A1 | | 4/2003 | Lyden | |

* cited by examiner

*Primary Examiner*—Marie Patterson
(74) *Attorney, Agent, or Firm*—Banner & Witcoff, Ltd.

(57) ABSTRACT

A sole structure for an article of footwear includes an upper plate and a heel plate assembly secured to the upper plate. The heel plate assembly extends downwardly from the upper plate such that the heel plate assembly forms an acute angle with the upper plate. A medial side of the heel plate assembly has a thickness greater than a thickness of a lateral side of the heel plate assembly. An article of footwear may include an upper secured to the sole structure.

47 Claims, 5 Drawing Sheets

FOOTWEAR WITH A HEEL PLATE ASSEMBLY

FIELD OF THE INVENTION

The present invention relates to the field of footwear. The invention concerns, more particularly, a heel plate assembly for a footwear sole structure that combines various heel plates and polymer foam elements.

BACKGROUND OF THE INVENTION

Conventional articles of athletic footwear include two primary elements, an upper and a sole structure. The upper is often formed of leather, synthetic materials, or a combination thereof and comfortably secures the footwear to the foot, while providing ventilation and protection from the elements. The sole structure generally incorporates multiple layers that are conventionally referred to as an insole, a midsole, and an outsole. The insole is a thin cushioning member located within the upper and adjacent the sole of the foot to enhance footwear comfort. The midsole, which is traditionally attached to the upper along the entire length of the upper, forms the middle layer of the sole structure and serves a variety of purposes that include controlling potentially harmful foot motions, such as over pronation, attenuating ground reaction forces, and absorbing energy. In order to achieve these purposes, the midsole may have a variety of configurations, as discussed in greater detail below. The outsole forms the ground-contacting element of footwear and is usually fashioned from a durable, wear resistant material that includes texturing to improve traction.

The primary element of a conventional midsole is a resilient, polymer foam material, such as polyurethane or ethyl vinyl acetate, that extends throughout the length of the footwear. The properties of the polymer foam material in the midsole are primarily dependent upon factors that include the dimensional configuration of the midsole and the specific characteristics of the material selected for the polymer foam, including the density of the polymer form material. By varying these factors throughout the midsole, the relative stiffness, degree of ground reaction force attenuation, and energy absorption properties may be altered to meet the specific demands of the activity for which the footwear is intended to be used.

In addition to polymer foam materials, conventional midsoles may include, for example, stabilizing devices that resist over-pronation and moderators that distribute ground reaction forces. The use of polymer foam materials in athletic footwear midsoles, while providing protection against ground reaction forces, may introduce instability that contributes to a tendency for over-pronation. Pronation is the inward roll of the foot while in contact with the ground. Although pronation is normal, it may be a potential source of foot and leg injury, particularly if it is excessive. Stability devices are often incorporated into the polymer foam material of the midsoles to control the degree of pronation in the foot. Examples of stability devices are found in U.S. Pat. No. 4,255,877 to Bowerman; U.S. Pat. No. 4,287,675 to Norton et al.; U.S. Pat. No. 4,288,929 to Norton et al.; U.S. Pat. No. 4,354,318 to Frederick et al.; U.S. Pat. No. 4,364,188 to Turner et al.; U.S. Pat. No. 4,364,189 to Bates; and U.S. Pat. No. 5,247,742 to Kilgore et al. In addition to stability devices, conventional midsoles may include fluid-filled bladders, as disclosed in U.S. Pat. Nos. 4,183,156 and 4,219,945 to Marion F. Rudy, for example.

As an alternative to the conventional midsole structures discussed above, various articles of footwear include flexible plates within the sole structure. For example, U.S. Pat. No. 4,566,206 to Weber discloses an article of footwear having a sole structure that includes a lower plate, an intermediate plate, and an upper plate. The lower plate extends along the entire longitudinal length of the footwear, whereas the upper and intermediate plates are positioned within a heel area of the sole structure. The upper and intermediate plates are joined with the lower plate and extend upwardly and rearwardly from, and at acute angles with respect to, the lower plate. In operation, the upper and intermediate plates provide different spring rates upon compression of the heel area of the sole structure.

U.S. Pat. No. 5,367,790 to Gamow et al. also discloses an article of footwear with a sole structure that includes flexible plates. The sole structure includes an upper plate that extends along the longitudinal length of the footwear and is secured to the upper. In addition, the sole structure includes a lower plate that is joined with the upper plate approximately two-thirds of the distance from the rear of the footwear to the front of the footwear. The upper plate and the lower plate purportedly form a collapsible longitudinal arch that stores energy during compression. A similar configuration is disclosed in U.S. Pat. No. 5,701,686 to Herr et al., which also discloses an additional forefoot plate that provides a spring structure in a forefoot portion of the footwear.

It is an object of the present invention to provide an article of footwear with a heel plate assembly that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide an article of footwear with a heel plate assembly that helps to reduce the negative effects of pronation.

In accordance with a first aspect, an article of footwear includes an upper and a sole structure secured to the upper. The sole structure includes an upper plate positioned adjacent the upper and extending longitudinally along at least a portion of the upper. A heel plate assembly is secured at one end thereof to the upper plate, and extends downwardly from the upper plate such that the heel plate assembly forms an acute angle with the upper plate. A medial side of the heel plate assembly has a thickness greater than a thickness of a lateral side of the heel plate assembly.

In accordance with another aspect, an article of footwear includes an upper and a sole structure secured to the upper. The sole structure includes an upper plate positioned adjacent the upper and extending longitudinally along at least a portion of the upper. A heel plate assembly is secured to the upper plate and extends downwardly from the upper plate such that the heel plate assembly forms an acute angle with the upper plate. The heel plate assembly includes a first layer and a second layer positioned on the first layer and having a width less than a width of the first layer. A third layer is positioned on the second layer and has a width less than the width of the second layer. A layer of foam material is secured to a lower surface of the upper plate and is positioned forwardly of the heel plate assembly.

In accordance with yet another aspect, an article of footwear includes an upper and a sole structure secured to the upper. The sole structure includes an upper plate positioned adjacent the upper and extending longitudinally along at least a portion of the upper. A heel plate assembly is secured to the upper plate and extends downwardly from the upper plate such that the heel plate assembly forms an acute angle with the upper plate. A medial side of the heel plate assembly has a thickness greater than a thickness of a lateral side of the heel plate assembly. A forefoot plate is secured to the upper plate and includes a first layer extending substantially across a width of the upper plate. A substantially C-shaped second layer is positioned on the first layer and opens toward a forward medial area of the first layer. A substantially V-shaped third layer is positioned on the second layer and has a medial finger extending along a medial edge of the second layer and a lateral finger extending along a lateral edge of the second layer.

In accordance with a further aspect, an article of footwear includes an upper and a sole structure secured to the upper. The sole structure includes an upper plate positioned adjacent the upper and extending longitudinally along at least a portion of the upper. A heel plate assembly is secured to the upper plate and extends downwardly from the upper plate such that the heel plate assembly forms an acute angle with the upper plate. A medial side of the heel plate assembly has a thickness greater than a thickness of a lateral side of the heel plate assembly. A forefoot plate is secured to the upper plate and includes a first spring arm having a forward portion extending downwardly and forwardly from the upper plate. A second spring arm extends forwardly and downwardly from the first spring arm. A third spring arm extends forwardly and downwardly from the second spring arm. A first wedge of foam material is positioned between a forefoot portion of the upper plate and the first spring arm. A second wedge of foam material is positioned between the first spring arm and the second spring arm. A third wedge of foam material is positioned between the second spring arm and the third spring arm. A fourth wedge of foam material is positioned between the upper plate and the heel plate assembly.

In accordance with yet a further aspect, an article of footwear includes an upper and a sole structure secured to the upper. The sole structure includes an upper plate positioned adjacent the upper and extending longitudinally along at least a portion of the upper. A plurality of slots is formed in a forefoot portion of the upper plate. Each of the slots extends transversely across at least a portion of the upper plate from one of a medial and lateral side of the upper plate. A heel plate assembly is secured at one end thereof to the upper plate and extends downwardly from the upper plate such that the heel plate assembly forms an acute angle with the upper plate. The heel plate assembly includes a first layer and a second layer positioned on the first layer and having a width less than a width of the first layer. A central portion of the second layer is spaced apart from a central portion of the first layer. A third layer is positioned on the second layer and has a width less than the width of the second layer. A central portion of the third layer is spaced apart from the central portion of the second layer. A layer of foam material is positioned above the upper plate and has a plurality of grooves extending transversely across at least a portion of a lower surface of the layer of foam material from one of a medial and lateral side of the layer of foam material.

Substantial advantage is achieved by providing footwear with a heel plate assembly. In particular, the negative effects of pronation can be reduced and additional support for the user's foot can be realized.

These and additional features and advantages of the invention disclosed here will be further understood from the following detailed disclosure of certain preferred embodiments.

Figure 1:
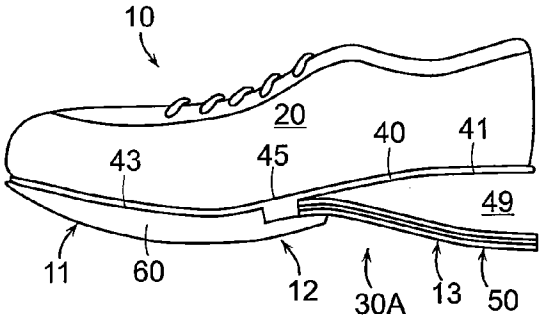
FIG. 1 is a side elevation view of an article of footwear having a first sole structure in accordance with an embodiment of the present invention.
Figure 2:
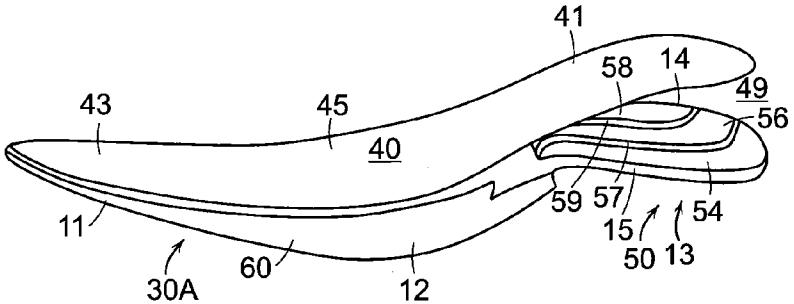
FIG. 2 is a perspective view of the first sole structure.
Figure 3:
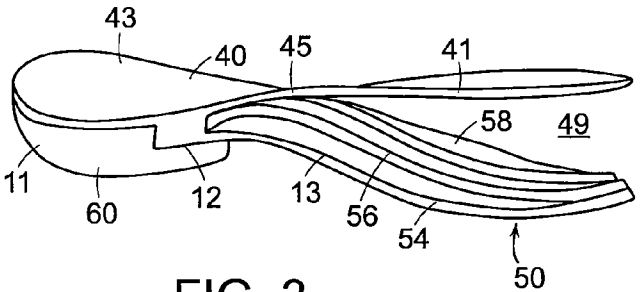
FIG. 3 is another perspective view of the first sole structure.

The figures referred to above are not drawn necessarily to scale and should be understood to present a representation of the invention, illustrative of the principles involved. Some features of the article of footwear with a heel plate assembly depicted in the drawings have been enlarged or distorted relative to others to facilitate explanation and understanding. The same reference numbers are used in the drawings for similar or identical components and features shown in various alternative embodiments. Articles of footwear with a heel plate assembly as disclosed herein, would have configurations and components determined, in part, by the intended application and environment in which they are used.

DETAILED DESCRIPTION OF CERTAIN PREFERRED EMBODIMENTS

The following discussion and accompanying figures disclose an article of footwear 10 in accordance with the present invention. Although footwear 10 is depicted as a running shoe in FIG. 1, various concepts related to the structure of footwear 10 may be applied to a plurality of other styles of athletic footwear, including basketball shoes, tennis shoes, walking shoes, and cross-training shoes, for example. In addition, the concepts disclosed with respect to footwear 10 may be applied to non-athletic footwear, such as dress shoes, boots, and sandals. The present invention, therefore, applies to a wide variety of footwear styles and is not limited to the precise embodiments disclosed herein.

Footwear 10 is constructed so as to reduce the negative effects of pronation, the inward roll of the foot while in contact with the ground, on a user's foot. Pronation manifests itself to a large degree during, for example, running. The typical motion of the foot during running proceeds as follows: First, the heel strikes the ground (referred to as heel-strike), followed by the ball of the foot striking the ground. As the heel leaves the ground, the foot rolls forward so that the toes make contact, and finally the entire foot leaves the ground (referred to as toe-off) to begin another cycle. During the time that the foot is in contact with the ground and rolling forward, the foot also rolls from the lateral side to the medial side, a process called pronation. That is, normally, at heel-strike, the outside of the heel strikes first, and at toe-off, the toes on the inside of the foot leave the ground last. While the foot is air borne and preparing for another cycle, the opposite process, called supination, occurs. Pronation, although normal, can be a potential source of foot and leg injury, particularly if it is excessive. As described below, footwear 10 is constructed so as to provide cushioning that helps to reduce the negative effects of pronation and to provide a vehicle for storing energy that can be used during toe-off.

The primary elements of footwear 10 are an upper 20 and one of sole structures 30A–30E, each of which will be discussed in detail below. With respect to FIG. 1, upper 20 is depicted as being secured to sole structure 30A in order to provide an example of the overall structure of footwear 10. As will become apparent during the following discussion of footwear 10, and particularly sole structures 30A–30E, an upper having the features and characteristics of upper 20 may also be secured to any one of sole structures 30A–30E.

Upper 20 forms an interior void that comfortably receives a foot and secures the position of the foot relative to sole structure 30A. The configuration of upper 20, as depicted, is suitable for use during athletic activities that primarily involve running. Accordingly, upper 20 may have a lightweight, breathable construction that includes multiple layers of leather, textile, polymer, and foam elements adhesively bonded and stitched together. For example, upper 20 may have an exterior that includes leather elements and textile elements for resisting abrasion and providing breathability, respectively. The interior of upper 20 may have foam elements for enhancing the comfort of footwear 10, and the interior surface may include a moisture-wicking textile for removing excess moisture from the area immediately surrounding the foot.

Figure 4:
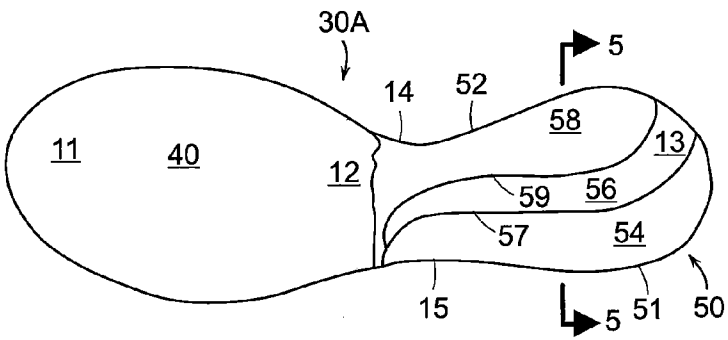
FIG. 4 is a partial top plan view of a heel plate assembly of the first sole structure.
Figure 5:
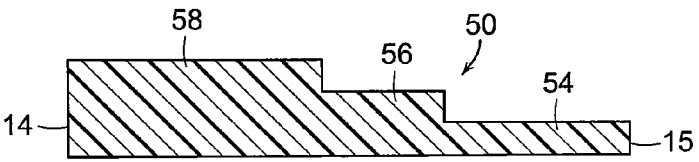
FIG. 5 is a section view of the heel plate assembly, as defined by line 5—5 in FIG. 4.

For purposes of general reference, footwear 10 may be divided into three general portions: a forefoot portion 11, a midfoot portion 12, and a heel portion 13, as depicted in FIG. 1. Portions 11–13 are not intended to demarcate precise areas of footwear 10. Rather, portions 11–13 are intended to represent general areas of footwear 10 that provide a frame of reference during the following discussion. In addition, as seen in FIG. 4, footwear 10 includes a medial, or inner, side 14 and a lateral, or outer, side 15. Although portions 11–13 and sides 14–15 apply generally to footwear 10, references to portions 11–13 and sides 14–15 may also apply specifically to upper 20, one of sole structures 30A–30E, or an individual component of upper 20 or sole structures 30A–30E.

In manufacturing footwear 10, the various elements of upper 20 are assembled around a last that imparts the general shape of a foot to the void within upper 20. That is, the various elements are assembled around the last to form a medial side and a lateral side that extend from forefoot portion 11 to heel portion 13; an instep portion that includes a throat, tongue, and laces; and an ankle opening in heel portion 13, for example. In addition, at least one of the elements of upper 20, or a separate element such as a strobel sock or lasting board, extends under the last to form a lower surface of upper 20. Sole structure 30A, or one of sole structures 30B–30E, is then permanently secured to the lower surface of upper 20 with an adhesive. Alternately, upper 20 and sole structure 30A may be secured through stitching or other suitable means. An insole (not depicted) is then positioned within upper 20 and adjacent the lower surface of upper 20 to essentially complete the manufacture of footwear 10. In this manner, footwear 10 is manufactured through a substantially conventional process.

Despite the substantially conventional process for manufacturing footwear 10, sole structures 30A–30E have a structure that differs significantly from a conventional sole structure for athletic footwear. In contrast with the conventional sole structure, wherein the primary elements are a foam midsole and a rubber outsole, the various sole structures 30A–30E include plates that effectively form a spring. The following discussion will focus on each of sole structures 30A–30E separately.

Sole structure 30A is depicted individually in FIGS. 2–5 and may include three primary elements: an upper plate 40, a heel plate assembly 50, and a foam element 60A. Upper plate 40 contacts upper 20 and substantially covers the entire lower surface of upper 20 to provide a supporting surface for the foot. That is, upper plate 40 extends longitudinally along substantially the entire length of upper 20, and upper plate 40 extends laterally from medial side 14 to lateral side 15 of upper 20. Upper plate 40 is shown in FIG. 4 partially broken away in order to more clearly illustrate the features of heel plate assembly 50.

Upper plate 40 is depicted as having a contour wherein a heel portion 41 of upper plate 40, which corresponds with heel portion 13 of footwear 10, is raised relative to a forefoot portion 43 of upper plate 40, which corresponds with forefoot portion 11 of footwear 10. In addition, a midfoot portion 45 of upper plate 40, which corresponds with midfoot portion 12 of footwear 10, forms a transition between the higher heel portion 41 and the lower forefoot portion 43 of upper plate 40.

In other preferred embodiments, upper plate 40 may have a substantially planar configuration. Alternately, upper plate 40 may include additional contours, including a raised arch support, a depression in the heel portion for receiving the heel, and a generally raised periphery, for example. Upper plate 40 is depicted as having a substantially uniform thickness. In further embodiments, the thickness of upper plate 40 may vary substantially to provide, for example, greater rigidity in specific areas or greater flexibility in other areas.

Heel plate assembly 50 is secured at a first end thereof to upper plate 40, and extends rearward and downward from upper plate 40 to its second end so as to form an acute angle with respect to upper plate 40. Accordingly, heel plate assembly 50 extends through midfoot portion 12 and heel portion 13 of sole structure 30A, and a space 49 is formed between upper plate 40 and heel plate assembly 50. As depicted in the figures, heel plate assembly 50 is formed of unitary, that is, one-piece, construction with upper plate 40, and its first end is secured at an approximate midpoint of upper plate 40. In other preferred embodiments, heel plate assembly 50 may be formed separate from upper plate 40 and secured to upper plate 40 with an adhesive or mechanical fastener. Furthermore, heel plate assembly 50 may be secured to upper plate 40 at locations other than its approximate midpoint.

Whereas upper plate 40 has a substantially uniform thickness in the illustrated embodiment, heel plate assembly 50 has an increasing thickness from a lateral side 15 to a medial side 14. As depicted in the cross-section of FIG. 5, the change in thickness occurs through a stepped structure in heel plate assembly 50.

Specifically, in the illustrated embodiment, heel plate assembly 50 is formed of a first layer 54, a second layer 56, and a third layer 58. First layer 54 extends across the width of heel portion 13. Second layer 56 is narrower than first layer 54, and third layer 58 is narrower than second layer 56. A lateral side edge 57 of second layer 56 follows an inverted S shaped path, and extends inwardly from lateral side 15 in mid portion 12 of footwear 10, bends rearwardly and extends longitudinally through heel portion 13, and then bends and extends outwardly to medial side 14.

A lateral side edge 59 of third layer 58 follows essentially the same contour as that of second layer 56, extending inwardly from lateral side 15 of mid portion 12 of footwear 10, bending rearwardly and extending longitudinally through heel portion 13 then bending and extending out to medial side 14.

The increasing thickness of heel plate assembly 50 from lateral side 15 to medial side 14 serves to reduce the effects of pronation. The thinner lateral portion is softer and less stiff, and therefore, provides less resistance to impact shocks than the thicker medial portion, which is harder and stiffer, and provides greater resistance to impact shocks. This variation in resistance acts in opposition to, and resists the natural forces of pronation. Thus, the resistance provided by heel plate assembly 50 increases from a rear lateral area of heel portion 13, where heel-strike occurs, to a forward medial area of heel portion 13.

Figure 6:
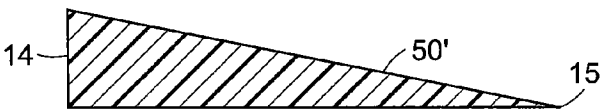
FIG. 6 is a section view of an alternate heel plate assembly that corresponds with the section view of FIG. 5.

It is to be appreciated that the size of the steps of heel plate assembly 50, that is, the respective thickness and widths, or depth, of each of first layer 54, second layer 56, and third layer 58 may vary depending on the degree or amount of resistance desired at any particular point along heel plate assembly 50. Further, in certain preferred embodiments, the delineation between each of the layers, or steps, of heel plate assembly 50 may not have a discreet step function, and may, in certain preferred embodiments exhibit a more gradual transition between layers. In other preferred embodiments there may be no discernible step between layers of heel plate assembly 50. For example, in certain preferred embodiments, as seen in FIG. 6, a heel plate assembly 50' may have a substantially triangular cross-section such that the resistance varies in linear fashion from lateral side 15 to medial side 14.

Upper plate 40 and heel plate assembly 50 may be made of a suitable energy-efficient material such as, for example, a fiber-reinforced composite. The fibers used in the composite material may include, but are not limited to, carbon and glass. The matrix, or resin, to which the fibers are added could include, but are not limited to, thermoset and thermoplastic resins. Other suitable materials having non-plastic properties will become readily apparent to those skilled in the art, given the benefit of this disclosure.

Foam element 60 extends beneath upper plate 40 from forefoot portion 11 to midfoot portion 12, extending beneath a forward portion of heel plate assembly 50. Foam element 60 provides cushioning for the user in the forefoot and midfoot portions 11, 12 of footwear 10. Foam element 60 may be formed of a polymer material, such as urethane, or ethyl vinyl acetate.

Figure 7:
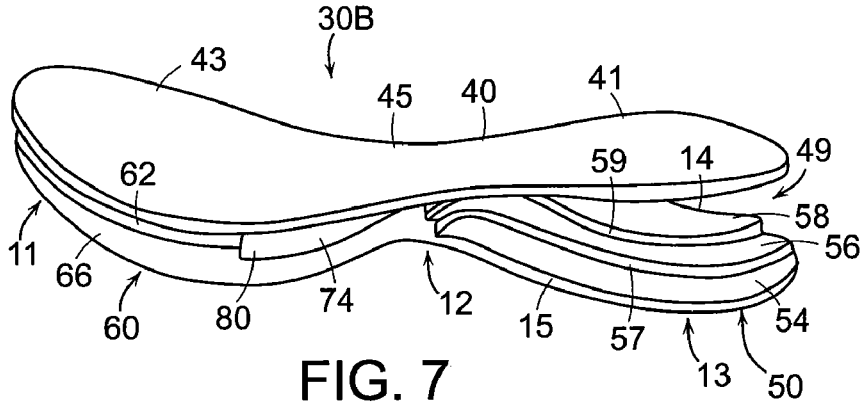
FIG. 7 is a perspective view of another embodiment of a sole structure in accordance with the present invention.
Figure 8:
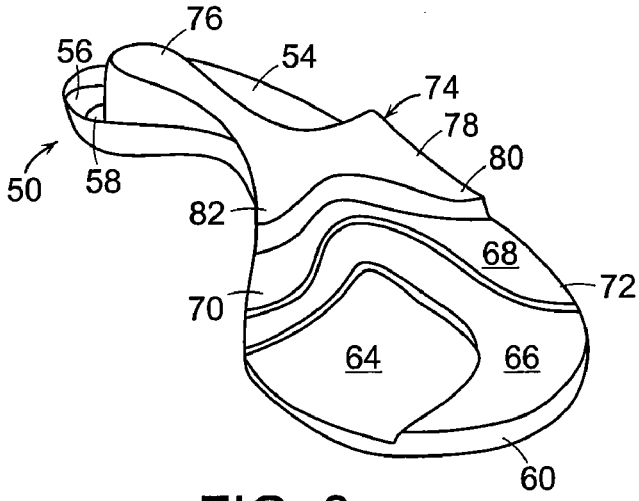
FIG. 8 is another perspective view of the sole structure of FIG. 7.

A preferred embodiment of sole structure 30B is seen in FIGS. 7–8. Upper plate 40 and spring plate 50 of sole structure 30B have the same construction as that described above with respect to FIGS. 1–6. Sole structure 30B has a forefoot plate 60 that extends forward and downward from upper plate 40 to its second end so as to form an acute angle with respect to upper plate 40. Accordingly, forefoot plate 60 extends through midfoot portion 12 and forefoot portion 11 of sole structure 30A, and a space 62 is formed between upper plate 40 and forefoot plate 60. As depicted in the figures, forefoot plate 60 is formed of unitary, that is, one-piece, construction with heel plate assembly 50. In other preferred embodiments, forefoot plate 60 may be formed separate from heel plate assembly 50, and secured to heel plate assembly 50 with an adhesive or mechanical fastener.

Forefoot plate 60 is formed of a first layer 64, a second layer 66, and a third layer 68. First layer 64 extends across the width of forefoot portion 11. Second layer 66 sits upon and covers only a portion of first layer 64. Third layer sits upon and covers only a portion of second layer 66. Second layer 66 is substantially C-shaped and opens toward a forward medial area of forefoot portion 11, such that the forward medial area of forefoot portion 11 has only first layer 64. Third layer 68 is substantially V-shaped with a medial finger 70 extending along a portion of the medial edge of first layer 64, and a lateral finger 72 extending along a portion of the lateral edge of first layer 64. Thus, forefoot plate 60 is thickest at a rear lateral area of forefoot portion 11 and is thinnest at a forward medial area of forefoot portion 11, where toe-off occurs. This decreasing thickness of forefoot plate 60 from lateral side 15 to medial side 14 also serves to reduce the effects of pronation. The thinner forward medial portion is softer and less stiff, and therefore, provides less resistance than the thicker rear lateral portion, which is harder and stiffer. This variation in resistance acts in opposition to, and resists the natural forces of pronation. Additionally, forefoot plate 60 acts to store energy as the foot moves from heel-strike to toe-off, and releases this stored energy during toe-off.

In certain preferred embodiments, a foam element 74 is positioned above heel plate assembly 50 and forefoot plate 60, and below upper plate 40. As seen in FIG. 8, foam element 74 includes a rear portion 76 and a forward portion 78. Rear portion 76 is a narrow strip that extends along medial side 14 of heel portion 13, and is positioned in gap 49 between heel plate assembly 50 and upper plate 40. Rear portion 76 is thickest at its rearmost edge, and decreases in thickness at its foremost edge where it joins with forward portion 78. Forward portion 78 includes a lateral finger 80 extending along lateral side 15 of midfoot portion 12, and a medial finger 82 extending along medial side 14 of midfoot portion 12. In preferred embodiments, the length of lateral finger 80 is longer than that of medial finger 82. Foam element 74 may be formed of a polymer material, such as urethane, or ethyl vinyl acetate.

Figure 9:
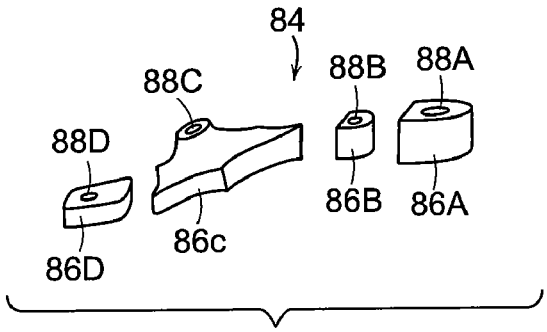
FIG. 9 is a perspective view of an alternative embodiment of a layer of foam material of the sole structure of FIG. 7.

In certain preferred embodiments, sole structure 30B may have a foam element 84 formed of a plurality of islands 86A–D, spaced apart slightly from one another as illustrated in FIG. 9. The combination of islands 86A–D generally takes the same overall shape of that of foam element 74. Islands 86A–B correspond to the shape of rear portion 76 of foam element 74, while islands 86C–D correspond to forward portion 78. In preferred embodiments, islands 86A–D include apertures 88A–D extending therethrough. By forming foam element 84 of separate islands and, more specifically, islands with apertures extending therethrough, the mass of foam element 84 may be reduced.

Figure 10:
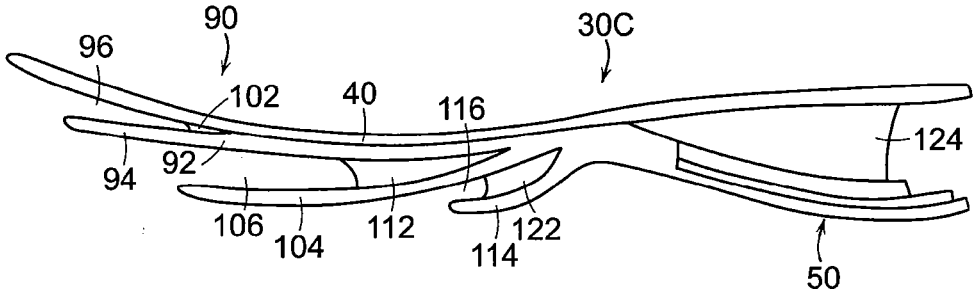
FIG. 10 is a side elevation view of another embodiment of a sole structure in accordance with the present invention.
Figure 11:
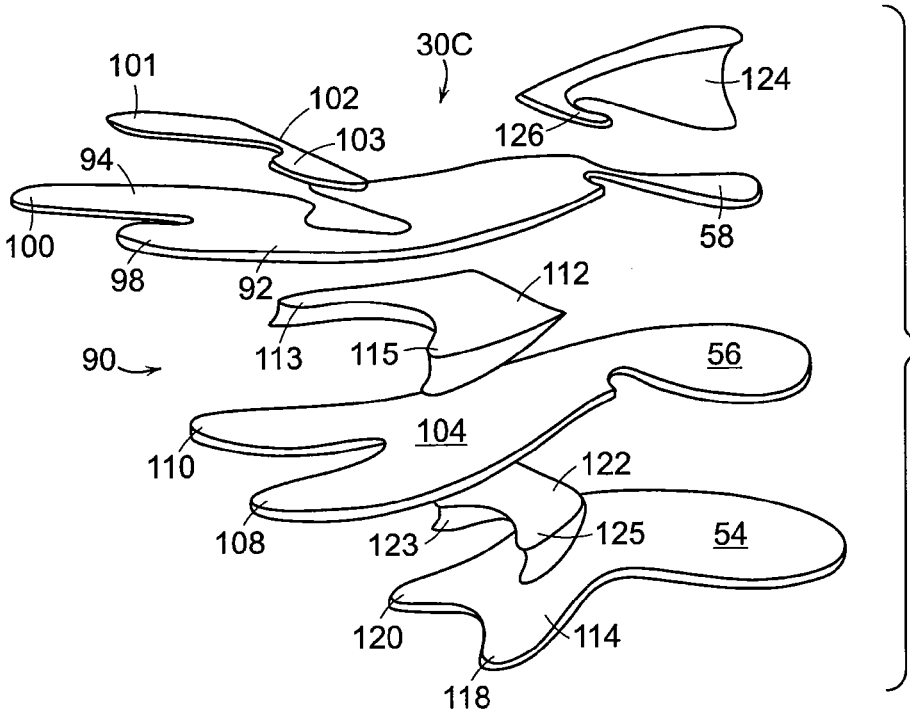
FIG. 11 is an exploded view of the sole structure of FIG. 10.

A preferred embodiment of sole structure 30C is shown in FIGS. 10–11. Upper plate 40 and spring plate 50 of sole structure 30C have the same construction as that described above with respect to FIGS. 1–6. Sole structure 30C has a forefoot plate 90 that extends beneath midfoot portion 12 and forefoot portion 11 of upper plate 40. As depicted in the figures, forefoot plate 90 is formed of unitary, that is, one-piece, construction with heel plate assembly 50. In other preferred embodiments, forefoot plate 90 may be formed separate from heel plate assembly 50, and secured to heel plate assembly 50 with an adhesive or mechanical fastener.

Forefoot plate includes a first spring arm 92 extending along a lower surface of upper plate 40 from midportion 12 to forefoot portion 11. The forward most portion of upper plate 40 curves slightly upwardly such that a forward portion 94 of first spring arm 92 extends away from and forms an acute angle with respect to upper plate 40, thereby forming a substantially triangular shaped gap 96 between forward portion 94 and upper plate 40. As seen in FIG. 11, forward portion 94 of first spring arm 92 includes a forwardly extending lateral finger 98, and a forwardly extending medial finger 100 spaced apart from lateral finger 98. In a preferred embodiment, medial finger 100 is longer than lateral finger 98. In certain preferred embodiments, a first wedge 102 of foam material is positioned in gap 96 to help cushion impact forces imparted by the user. First wedge 102 includes a forwardly extending medial finger 101 and a forwardly extending lateral finger 103 spaced from medial finger 101. In preferred embodiments, the length of medial finger 101 is longer than that of lateral finger 103.

A second spring arm 104 extends forwardly and downwardly from a rear portion of first spring arm 92, forming an acute angle with first spring arm 92 and a substantially triangular shaped gap 106 between first spring arm 92 and second spring arm 94. In certain preferred embodiments, second spring arm 104 has a slight upward curve along its length. As seen in FIG. 11, second spring arm 104 includes a forwardly extending lateral finger 108, and a forwardly extending medial finger 110 spaced apart from lateral finger 108. In a preferred embodiment, medial finger 110 is longer than lateral finger 108. In certain preferred embodiments, a second wedge 112 of foam material is positioned in gap 106 to help cushion impact forces imparted by the user. Second wedge 112 includes a forwardly extending medial finger 113 and a forwardly extending lateral finger 115 spaced from medial finger 113. In preferred embodiments, the length of medial finger 113 is longer than that of lateral finger 115.

A third spring arm 114 extends forwardly and downwardly from a rear portion of second spring arm 104, forming an acute angle with second spring arm 104 and a substantially triangular shaped gap 116 between second spring arm 104 and third spring arm 114. In certain preferred embodiments, third spring arm 114 has a slight upward curve along its length. As seen in FIG. 11, third spring arm 114 includes a forwardly extending lateral finger 118, and a forwardly extending medial finger 120 spaced apart from lateral finger 118. In a preferred embodiment, medial finger 120 is longer than lateral finger 118. In certain preferred embodiments, a third wedge 122 of foam material is positioned in gap 116 to help cushion impact forces imparted by the user. Third wedge 122 includes a forwardly extending medial finger 123 and a forwardly extending lateral finger 125 spaced from medial finger 123. Third wedge 122 and fingers 123, 125 not only help with cushioning, but also support the midfoot portion 12, or arch, of the user's foot, and enhance transition from heel-strike to toe-off.

In certain preferred embodiments, a fourth wedge 124 of foam material is positioned in gap 49, between upper plate 40 and heel plate assembly 50. Fourth wedge 124 extends along medial side 14 and decreases in thickness from a rear to a forward portion thereof. A thin transverse finger 126 extends from the forward portion of fourth wedge 124 toward lateral side 15. Wedges 102, 112, 122, and 124 may be formed of any of the foam materials described above.

Figure 12:
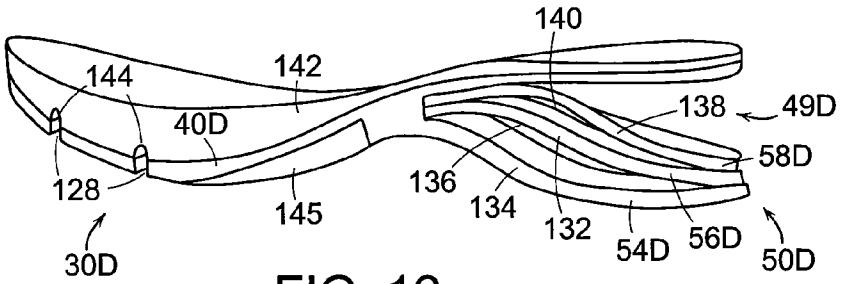
FIG. 12 is a side elevation view of another embodiment of a sole structure in accordance with the present invention.
Figure 13:
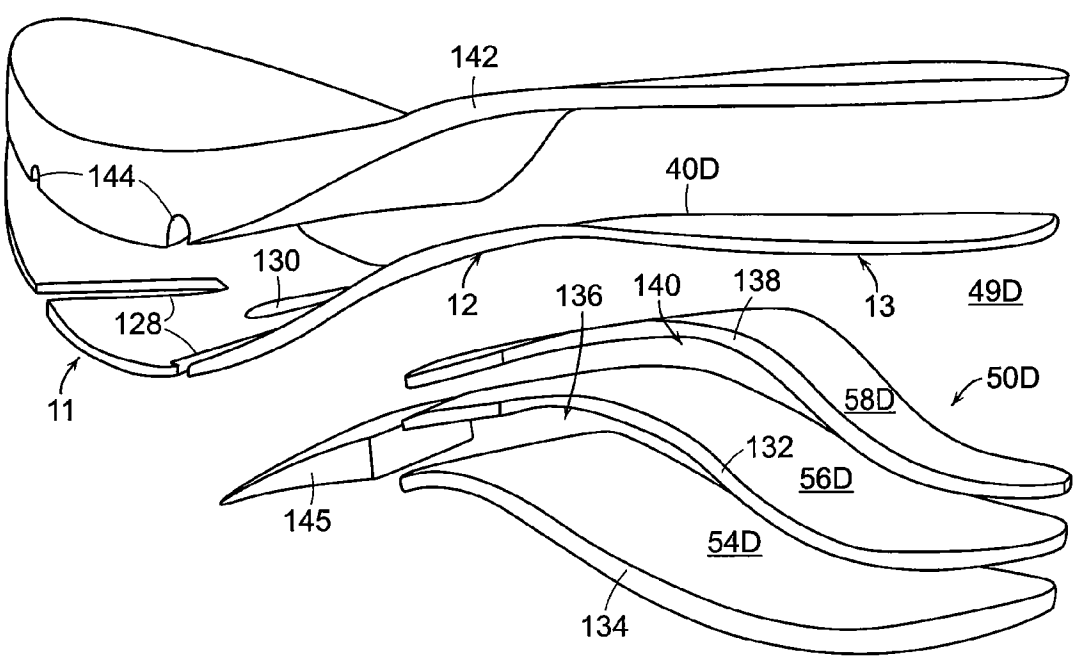
FIG. 13 is an exploded view of the sole structure of FIG. 12.

A preferred embodiment of sole structure 30D is shown in FIGS. 12–13. An upper plate 40D of sole structure 30D has the same general construction as that of upper plate 40 described above. However, forefoot portion 11 of upper plate 40D includes a plurality of slots. Each slot of a pair of slots 128 extends from lateral side 15 transversely across forefoot portion 11, extending across approximately half of upper plate 40. A slot 130 extends from medial side 14 transversely across forefoot portion 11, extending across approximately half of upper plate 40. Slot 130 is positioned approximately halfway between slots 128. Slots 126, 128 serve to improve the flexibility of forefoot portion 11 of upper plate 40. It is to be appreciated that upper plate may include more or less than three such slots, and that each slot could extend more or less than halfway across upper plate 40.

Sole structure 30D includes a heel plate assembly 50D, which is secured at a first end thereof to upper plate 40D, and extends rearward and downward from upper plate 40 to its second end so as to form an acute angle with respect to upper plate 40D. Accordingly, heel plate assembly 50D extends through midfoot portion 12 and heel portion 13 of sole structure 30D, and a space 49D is formed between upper plate 40D and heel plate assembly 50D. In a preferred embodiment, as illustrated in FIG. 12, heel plate assembly 50D is formed of unitary, that is, one-piece, construction with upper plate 40D, and its first end is secured at an approximate midpoint of upper plate 40D. In other preferred embodiments, as illustrated in FIG. 13, heel plate assembly 50D may be formed separate from upper plate 40D and secured to upper plate 40D with an adhesive or mechanical fastener. Furthermore, heel plate assembly 50D may be secured to upper plate 40D at locations other than its approximate midpoint.

Whereas upper plate 40D has a substantially uniform thickness in the illustrated embodiment, heel plate assembly 50D has an increasing thickness from a lateral side 15 to a medial side 14. Heel plate assembly 50D is formed of a first layer 54D, a second layer 56D, and a third layer 58D. First layer 54D extends across the width of heel portion 13. Second layer 56D is narrower than first layer 54D, and third layer 58D is narrower than second layer 56D.

The slope of a central portion 132 of second layer 56D with respect to upper plate 40D is steeper than the slope of a central portion 134 of first layer 54D with respect to upper plate 40D, such that central portion 132 is spaced apart from central portion 134, forming a gap 136 between central portion 132 of second layer 56D and central portion 134 of first layer 54D. Similarly, the slope of a central portion 138 of third layer 58D with respect to upper plate 40D is steeper than the slope of central portion 132 of second layer 56D with respect to upper plate 40D, such that central portion 138 is spaced apart from central portion 132, forming a gap 140 between central portion 132 of second layer 56D and central portion 138 of third layer 58D. By varying the slope of layers 54D, 56D, and 58D, the relative stiffness across heel place 50D is varied as well. Specifically, heel plate 50D is less stiff on lateral side 15, and stiffer on medial side 14 to help control pronation.

A layer of foam material 142 may be positioned above upper plate 40D, extending substantially along the length and width of upper plate 40D and having substantially the same profile as upper plate 40D. A plurality of grooves 144 is formed in a lower surface of forefoot portion 11 of foam material 142. In the illustrated embodiment, upper plate 40D has three grooves 144, which correspond to, and are aligned with, slots 128, 130 formed in upper plate 40D. Consequently, in this embodiment, a pair of grooves 144 extends transversely from lateral side 15 of foam material 142 and a single groove 144 (not shown) extends transversely from medial side 14 of foam material 142. A wedge 145 of foam material, which tapers from a thick rear portion to a thin forward portion, is positioned forwardly of heel plate assembly 50D and below upper plate 40D.

Figure 14A:
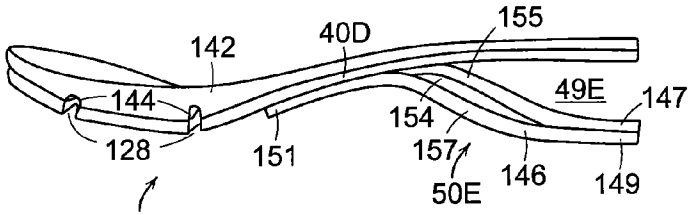
FIGS. 14A–C are side elevation views of another embodiment of a sole structure in accordance with the present invention, shown with varying levels of resistance.
Figure 14B:
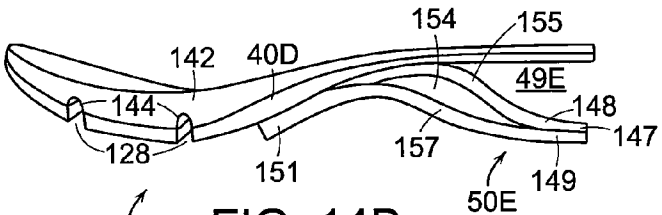
Figure 14C:
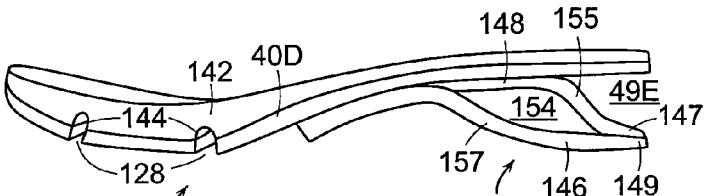

A preferred embodiment of sole structure 30E is shown in FIGS. 14A–C. Sole structure 30E includes an upper plate 40D and foam layer 142 of the same construction as that described above in connection with FIGS. 12–13. Sole structure 30E includes an adjustable heel plate assembly 50E, which is spaced apart from upper plate 40D by gap 49E. Heel plate assembly 50E is shown in greater detail in FIGS. 15A–C, which correspond to FIGS. 14A–C, respectively. Heel plate assembly 50E is shown in a first orientation in FIGS. 14A and 15A, in a second orientation in FIGS. 14B and 15B, and in a third orientation in FIGS. 14C and 15C. As described in greater detail below, heel plate assembly 50E exhibits the least stiffness, or resistance in the first orientation, a greater amount in the second orientation, and an even greater amount in the third orientation.

Heel plate assembly 50E comprises a first layer 146, which has a fixed position with respect to footwear 10. An adjustable second layer 148, which is narrower than first layer 146, is positioned above first layer 146. A first end 147 of second layer 148 in heel portion 13 is secured to a first end 149 of first layer 146 in heel portion 13, along the medial side 14 of first layer 146. Thus, heel plate assembly 50E is thicker at its medial side 14 than at its lateral side 15.

Figure 15A:
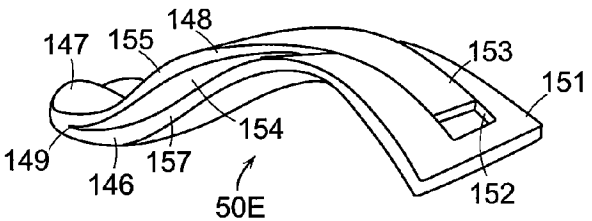
FIGS. 15A–C are perspective views of the heel plate assembly of the sole structure of FIGS. 14A–C.

A slot 152 is formed in first layer 146, and extends longitudinally and rearwardly from a point proximate a second end 151 of first layer 146. A second end 153 of second layer 148, which is the forward portion of second layer 148, is slidably received in slot 152. Second layer 148 extends rearwardly from its point of engagement with slot 152 and then bends down to its first end 147, creating a gap 154 between a central portion 155 of second layer 148 and a central portion 157 of first layer 146. The size of gap 154 and the steepness of the angle of inclination of central portion 155 of second layer 148 vary based on the point at which second end 153 of second layer 148 engages slot 152. For example, as seen in FIGS. 14A, 15A, second end 153 of second layer 148 engages slot 152 proximate the forward end of slot 152 such that the angle of inclination of central portion 155 of second layer 148 is relatively shallow. Thus, in this position, heel plate assembly 50E exhibits a relatively low level of stiffness or resistance for the user.

Figure 15B:
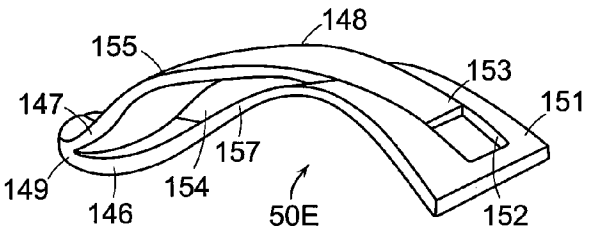
Figure 15C:
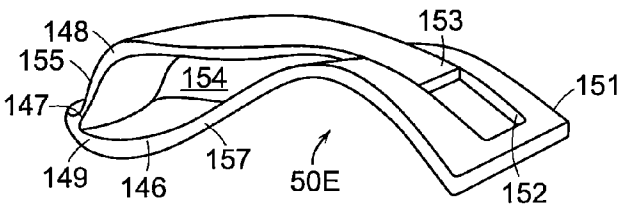

As seen in FIGS. 14B, 15B, second layer 148 engages slot 152 proximate a central area of slot 152, such that the angle of inclination of central portion 155 is steeper than that seen in FIGS. 14A, 15A. In this position, heel plate assembly 50E exhibits a medium level of stiffness. As seen in FIGS. 14C, 15C, second layer 148 engages slot 152 proximate a rear area of slot 152, such that the angle of inclination of central portion 155 is steeper than that seen in FIGS. 14B, 15B. In this position, heel plate assembly 50E exhibits a relatively high level of stiffness or resistance for the user. Although heel plate assembly 50E is shown here with three levels of stiffness, it is to be appreciated that heel plate assembly 50E has an infinite number of possible levels of stiffness.

Second layer 148 may be adjusted with respect to first layer 146 when footwear 10 is manufactured. Alternatively, second layer 148 may be adjustable with respect to first layer 146 by the user during use.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. An article of footwear comprising, in combination:

an upper; and a sole structure secured to the upper, the sole structure comprising:

an upper plate positioned adjacent the upper and extending longitudinally along at least a portion of the upper; and a heel plate assembly secured at one end thereof to the upper plate, the heel plate assembly extending downwardly from the upper plate such that the heel plate assembly forms an acute angle with the upper plate, a medial side of the heel plate assembly having a thickness greater than a thickness of a lateral side of the heel plate assembly, the entire heel plate assembly being formed of a single material.

2. The article of footwear of claim 1, wherein the heel plate assembly comprises a first layer, a second layer positioned on the first layer and having a width less than a width of the first layer, and a third layer positioned on the second layer and having a width less than the width of the second layer.

3. The article of footwear of claim 2, wherein a central portion of the first layer is spaced apart from a central portion of the second layer, and the central portion of the second layer is spaced apart from a central portion of the third layer.

4. The article of footwear of claim 1, further comprising a layer of foam material positioned above the upper plate.

5. The article of footwear of claim 4, wherein a plurality of grooves is formed in a lower surface of the layer of foam material.

6. The article of footwear of claim 1, wherein a plurality of slots is formed in a forefoot portion of the upper plate.

7. The article of footwear of claim 6, wherein each of the slots extends transversely across at least a portion of the upper plate from one of a medial and lateral side of the upper plate.

8. The article of footwear of claim 1, wherein the upper plate and heel plate assembly are formed of a fiber-reinforced composite.

9. The article of footwear of claim 1, wherein the upper plate and heel plate assembly are formed of a carbon fiber composite.

10. The article of footwear of claim 1, further comprising a layer of foam material secured to a lower surface of the upper plate and positioned forwardly of the heel plate assembly.

11. The article of footwear of claim 10, wherein a rear portion of the layer of foam material extends beneath a front portion of the heel plate assembly.

12. The article of footwear of claim 1, further comprising a forefoot plate secured to the upper plate, a rear lateral portion of the forefoot plate having a thickness greater than a forward medial portion of the forefoot plate.

13. The article of footwear of claim 12, wherein the forefoot plate and heel plate assembly are of unitary construction.

14. The article of footwear of claim 12, wherein the forefoot plate is formed of a fiber-reinforced composite.

15. The article of footwear of claim 12, wherein the forefoot plate is formed of a carbon fiber composite.

16. The article of footwear of claim 12, further comprising a layer of foam material positioned beneath a midfoot portion of the upper plate, above a rear portion of the forefoot plate, and above a forward portion of the heel plate assembly.

17. The article of footwear of claim 16, wherein the layer of foam material comprises a plurality of pieces of foam.

18. The article of footwear of claim 1, further comprising a forefoot plate secured to the upper plate.

19. The article of footwear of claim 18, wherein the forefoot plate comprises:

a first spring arm having a forward portion extending downwardly and forwardly from the upper plate;

a second spring arm extending forwardly and downwardly from the first spring arm; and a third spring arm extending forwardly and downwardly from the second spring arm.

20. The article of footwear of claim 19, wherein the first spring arm has a length longer than a length of the second spring arm, and the length of the second spring arm is longer than a length of the third spring arm.

21. The article of footwear of claim 19, wherein a forward portion of the first spring arm includes a medial finger and a lateral finger.

22. The article of footwear of claim 21, wherein the medial finger has a length longer than a length of the lateral finger.

23. The article of footwear of claim 19, wherein a forward portion of the second spring arm includes a medial finger and a lateral finger.

24. The article of footwear of claim 23, wherein the medial finger has a length longer than a length of the lateral finger.

25. The article of footwear of claim 19, wherein a forward portion of the third spring arm includes a medial finger and a lateral finger.

26. The article of footwear of claim 25, wherein the medial finger has a length longer than a length of the lateral finger.

27. The article of footwear of claim 19, further comprising a first wedge of foam material positioned between a forefoot portion of the upper plate and the first spring arm.

28. The article of footwear of claim 19, further comprising a second wedge of foam material positioned between the first spring arm and the second spring arm.

29. The article of footwear of claim 19, further comprising a third wedge of foam material positioned between the second spring arm and the third spring arm.

30. The article of footwear of claim 19, further comprising a fourth wedge of foam material positioned between the upper plate and the heel plate assembly.

31. The article of footwear of claim 18, wherein the forefoot plate is formed of a fiber-reinforced composite.

32. The article of footwear of claim 18, wherein the forefoot plate is formed of a carbon fiber composite.

33. The article of footwear of claim 18, wherein the forefoot plate and heel plate assembly are of unitary construction.

34. The article of footwear of claim 18, wherein the forefoot plate comprises a first layer, a second layer positioned on the first layer, and a third layer positioned on the second layer.

35. The article of footwear of claim 34, wherein the first layer extends substantially across a width of the upper plate.

36. The article of footwear of claim 34, wherein the second layer is substantially C-shaped and opens toward a forward medial area of the first layer.

37. The article of footwear of claim 34, wherein the third layer is substantially V-shaped, and has a medial finger extending along a medial edge of the second layer and a lateral finger extending along a lateral edge of the second layer.

38. The article of footwear of claim 1, wherein the heel plate assembly comprises a first layer having a first end and a second end, and a second layer positioned above the first layer and having a first end and a second end, the first end of the second layer secured to the first end of the first layer, a central portion of the second layer spaced apart from a central portion of the first layer, and the second end of the second layer being adjustably secured to the second end of the first layer so as to vary a size of a gap formed between the central portion of the first layer and the central portion of the second layer and to vary the steepness of the central portion of the second layer with respect to the upper plate.

39. The article of footwear of claim 38, wherein the second end of the second layer is slidable within a slot formed in the second end of the first layer.

40. An article of footwear comprising, in combination:

an upper;

a sole structure secured to the upper, the sole structure comprising:

an upper plate positioned adjacent the upper and extending longitudinally along at least a portion of the upper; and a heel plate assembly secured at one end thereof to the upper plate, the heel plate assembly extending downwardly from the upper plate such that the heel plate assembly forms an acute angle with the upper plate, the heel plate assembly comprising a first layer;

a second layer positioned on the first layer and having a width less than a width of the first layer; and a third layer positioned on the second layer and having a width less than the width of the second layer, the first layer, second layer and third layer being formed of a single material; and a layer of foam material secured to a lower surface of the upper plate and positioned forwardly of the heel plate assembly.

41. An article of footwear comprising, in combination:

an upper;

a sole structure secured to the upper, the sole structure comprising:

an upper plate positioned adjacent the upper and extending longitudinally along at least a portion of the upper;

a heel plate assembly secured at one end thereof to the upper plate, the heel plate assembly extending downwardly from the upper plate such that the heel plate assembly forms an acute angle with the upper plate, a medial side of the heel plate assembly having a thickness greater than a thickness of a lateral side of the heel plate assembly; and a forefoot plate secured to the upper plate and comprising a first layer extending substantially across a width of the upper plate;

a substantially C-shaped second layer positioned on the first layer and opening toward a forward medial area of the first layer; and a substantially V-shaped third layer positioned on the second layer and having a medial finger extending along a medial edge of the second layer and a lateral finger extending along a lateral edge of the second layer.

42. An article of footwear comprising, in combination:

an upper;

a sole structure secured to the upper, the sole structure comprising:

an upper plate positioned adjacent the upper and extending longitudinally along at least a portion of the upper;

a heel plate assembly secured at one end thereof to the upper plate, the heel plate assembly extending downwardly from the upper plate such that the heel plate assembly forms an acute angle with the upper plate, a medial side of the heel plate assembly having a thickness greater than a thickness of a lateral side of the heel plate assembly; and a forefoot plate secured to the upper plate, the forefoot plate comprising a first spring arm having a forward portion extending downwardly and forwardly from the upper plate;

a second spring arm extending forwardly and downwardly from the first spring arm; and a third spring arm extending forwardly and downwardly from the second spring arm;

a first wedge of foam material positioned between a forefoot portion of the upper plate and the first spring arm;

a second wedge of foam material positioned between the first spring arm and the second spring arm; and a third wedge of foam material positioned between the second spring arm and the third spring arm; and a fourth wedge of foam material positioned between the upper plate and the heel plate assembly.

43. The article of footwear of claim 42, wherein the first spring arm has a length longer than a length of the second spring arm, and the second spring arm has a length longer than a length of the third spring arm.

44. The article of footwear of claim 42, wherein a forward portion of the first spring arm includes a medial finger and a lateral finger, the medial finger having a length longer than a length of the lateral finger.

45. The article of footwear of claim 42, wherein a forward portion of the second spring arm includes a medial finger and a lateral finger, the medial finger having a length longer than a length of the lateral finger.

46. The article of footwear of claim 42, wherein a forward portion of the third spring arm includes a medial finger and a lateral finger, the medial finger having a length longer than a length of the lateral finger.

47. An article of footwear comprising, in combination:

an upper;

a sole structure secured to the upper, the sole structure comprising:

an upper plate positioned adjacent the upper and extending longitudinally along at least a portion of the upper, a plurality of slots being formed in a forefoot portion of the upper plate, each of the slots extending transversely across at least a portion of the upper plate from one of a medial and lateral side of the upper plate; and a heel plate assembly secured at one end thereof to the upper plate, the heel plate assembly extending downwardly from the upper plate such that the heel plate assembly forms an acute angle with the upper plate, the heel plate assembly comprising a first layer;

a second layer positioned on the first layer and having a width less than a width of the first layer, a central portion of the second layer being spaced apart from a central portion of the first layer; and a third layer positioned on the second layer and having a width less than the width of the second layer, a central portion of the third layer being spaced apart from the central portion of the second layer, and a layer of foam material positioned above the upper plate and having a plurality of grooves extending transversely across at least a portion of a lower surface of the layer of foam material from one of a medial and lateral side of the layer of foam material.

* * * * *